US007273838B2

(12) United States Patent
Shah et al.

(10) Patent No.: US 7,273,838 B2
(45) Date of Patent: Sep. 25, 2007

(54) LAUNDRY DETERGENT FORMULATION INCLUDING DIRT SUSPENDING AGENT COMPRISING BENZALKONIUM CHLORIDE AND ISOBUTYLENE-MALEIC ANHYDRIDE

(75) Inventors: Purvita Shah, Jersey City, NJ (US); Michael J. Jurek, Oak Ridge, NJ (US)

(73) Assignee: ISP Investments Inc, Wilmington, DE (US)

( * ) Notice: Subject to any disclaimer, the term of this patent is extended or adjusted under 35 U.S.C. 154(b) by 417 days.

(21) Appl. No.: 10/963,269

(22) Filed: Oct. 12, 2004

(65) Prior Publication Data

US 2006/0079436 A1 Apr. 13, 2006

(51) Int. Cl.
*C11D 1/62* (2006.01)
*C11D 3/37* (2006.01)

(52) U.S. Cl. ..... 510/361; 510/276; 510/400; 510/299; 510/319; 510/382; 510/384; 510/391; 510/476; 510/504; 510/515; 510/517; 510/528; 510/533; 510/318

(58) Field of Classification Search ..... 510/276, 510/400, 299, 319, 382, 384, 391, 476, 504, 510/515, 517, 528, 533, 318, 361
See application file for complete search history.

(56) References Cited

U.S. PATENT DOCUMENTS

| | | | | |
|---|---|---|---|---|
| 4,184,970 | A * | 1/1980 | Draper, Jr. | 510/330 |
| 4,255,294 | A * | 3/1981 | Rudy et al. | 510/331 |
| 4,265,772 | A * | 5/1981 | Jones | 510/330 |
| 4,292,035 | A * | 9/1981 | Battrell | 8/137 |
| 4,321,165 | A * | 3/1982 | Smith et al. | 510/350 |
| 4,790,856 | A * | 12/1988 | Wixon | 8/137 |
| 6,087,314 | A * | 7/2000 | Heinzman et al. | 510/352 |
| 6,306,805 | B1 * | 10/2001 | Bratescu et al. | 510/123 |
| 6,596,678 | B2 * | 7/2003 | Panandiker et al. | 510/303 |
| 6,864,196 | B2 * | 3/2005 | Graham et al. | 442/59 |
| 6,984,618 | B2 * | 1/2006 | Heinzman et al. | 510/507 |
| 2003/0207630 | A1 * | 11/2003 | Graham et al. | 442/118 |

* cited by examiner

*Primary Examiner*—Charles Boyer
(74) *Attorney, Agent, or Firm*—William J. Davis; Walter Katz

(57) ABSTRACT

A laundry detergent formulation includes a dirt suspending agent which is a blend of an anionic material, such as an anionic polymer, and a quaternary ammonium salt. This suspending agent prevents redeposition of dirt which is removed from clothing by a laundry detergent from redepositing onto cleaned clothes during the wash cycle, while allowing it to be removed completely during the rinse cycle.

2 Claims, 2 Drawing Sheets

LAUNDRY DETERGENT FORMULATION INCLUDING DIRT SUSPENDING AGENT COMPRISING BENZALKONIUM CHLORIDE AND ISOBUTYLENE-MALEIC ANHYDRIDE

BACKGROUND OF THE INVENTION

1. Field of the Invention

This invention relates to laundry detergent formulations, and, more particularly, to a dirt suspending agent for such formulations, which can prevent dirt removed from fabrics from redepositing in the wash liquor.

2. Description of the Prior Art

Laundry detergents are well known in the art. These formulations typically employ a variety of surfactants and/or soil anti-redeposition materials to achieve suspension of dirt particulates removed from clothes during the wash cycle. Vigorous agitation during the wash cycle is necessary because dirt can remain suspended for only a finite time before settling out and redepositing onto the clean clothes.

Accordingly, it is an object of this invention to provide a laundry formulation which includes a dirt suspending agent to prevent dirt particulates from redepositing onto the cleaned clothes during the wash cycle.

Another object of this invention is to provide a dirt suspending agent for use in a laundry formulation which is a blend of an anionic material and a quaternary ammonium salt.

IN THE DRAWINGS

SUMMARY OF THE INVENTION

What is described herein is a dirt suspending agent for use in a laundry detergent formulation which is a blend or complex of (a) an anionic material and (b) a quaternary ammonium salt.

Preferred dirt suspending agents of the invention include (a) an anionic polymer and (b) a low molecular weight quaternary ammonium salt.

Alternatively, (a) is an anionic surfactant and (b) is a polymeric quaternary ammonium salt; or both (a) and (b) are polymers, e.g. low molecular weight polymers.

A particular dirt suspending agent of the invention includes (a) isobutylene-maleic anhydride copolymer (IREZ®-160-ISP) and (b) a low molecular weight quaternary ammonium salt.

That the dirt suspending agent of the invention is effective is evidenced by the dirty laundry solution increasing its haziness immediately after use and because the haze remains substantially constant for a period of at least 24 hours thereafter, i.e. the dirt remains suspended in the wash liquor to prevent redeposition onto the cleaned fabric.

As another feature of the invention, there is provided a method of preventing or reducing redeposition of dirt onto cleaned fabrics, e.g. cotton, during the laundry cycle by including the dirt suspending agent in the laundry formulation.

DETAILED DESCRIPTION OF THE INVENTION

In accordance with the invention, the dirt suspending agent herein is a blend of two chemical moieties which are used synergistically and advantageously in a laundry detergent formulation. This suspending agent allows for long-time suspension of fine particles in an aqueous medium. This property is particularly valued in laundry application where dirt removed from clothing during the wash cycle needs to be suspended in the wash liquor for sometime to prevent redeposition onto the cleaned fabrics. Later the suspended dirt is removed during the rinse cycle.

Suitably, the dirt suspending agent of the invention is a blend or complex of an anionic material and a quaternary ammonium salt, preferably an anionic polymer and a low molecular weight quaternary ammonium salt. Alternatively, the agent herein may comprise an anionic surfactant and a polymeric quat; also both materials may be polymers, preferably low molecular weight polymers.

Most preferably, the dirt suspending agent of the invention is a complex of isobutylene-maleic anhydride copolymer (IREZ®-160-(ISP) and a low molecular weight quaternary ammonium salt, e.g. benzalkonium chloride. Suitably the complex is formed in a wt. ratio of about 50:50 to 80:20, preferably about 60:40 to 70:30.

Figure 1:
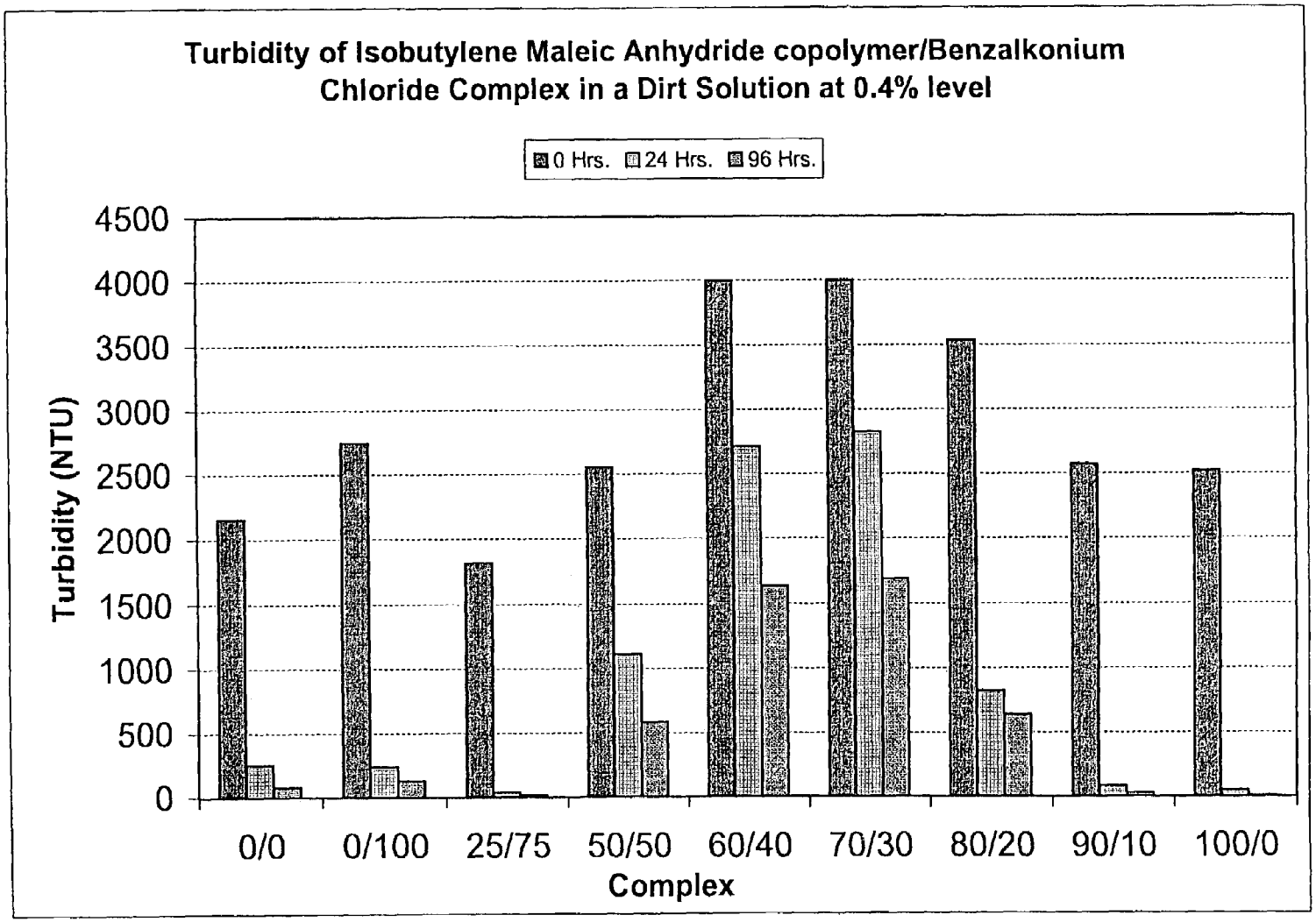
FIG. 1 shows the soil suspending ability of the compositions of the invention in use in laundry cleaning.

The complex suitably is present in an amount of 0.1 to 2 wt. %, preferably 0.2 to 0.6 wt. %. FIG. 1 shows the effectiveness of the complex in these amounts (0.4 wt. %) where the haze (turbidity) increases substantially initially and remains high even after 1 day.

The complex also was tested in a standard laundry detergent formulation, i.e. an anti-soil redeposition test, described below.

Anti-Soil Redeposition Test

Testing was performed with a Terg-O-Tometer using washing bins equilibrated to 100° F. containing a solution with 1.9 g/0.5 L of clay slurry, 150 ppm hard water, and optionally, 40 ppm polymer, followed by dilution to 0.5 L with $DiH_2O$. Following agitation and equilibration, two cotton fabrics were added to the bin and the washing process was run for 30 minutes at an agitation rate of 100 cycles/minute. Each swatch was removed from the bin and excess water was removed by hand. A rinse solution was prepared with 150 ppm hard water, diluted to 0.5 L with $DiH_2O$ and added to each Terg-O-Tometer bin. Each fabric was added to the solution for a 3-minute rinse. Following the rinse, excess water was removed by hand and allowed to air dry. A minimum of six reflectance measurements (3 on each fabric) was taken per swatch using a Hunter Colorimeter (ColorQuest II), recording the average values of L*, a*, b*, ΔE, and the λ difference between Δ 450-470 nm. A plot was generated using the Δ 460 nm value, defined as the difference between the starting fabric and the washed fabric. A wavelength reading closer to zero at 460 nm translates to less deposited soil.

Standard Detergent Composition:

| Component | Wt. % |
|---|---|
| Distilled water | 51.4 |
| Linear alkene benzene sulfonate | 9.35 |

-continued

| Component | Wt. % |
|---|---|
| LES | 9.35 |
| Neodol 25-9 | 14.0 |
| Proplyene Glycol | 9.35 |
| Sodium Citrate | 6.55 |

Figure 2:
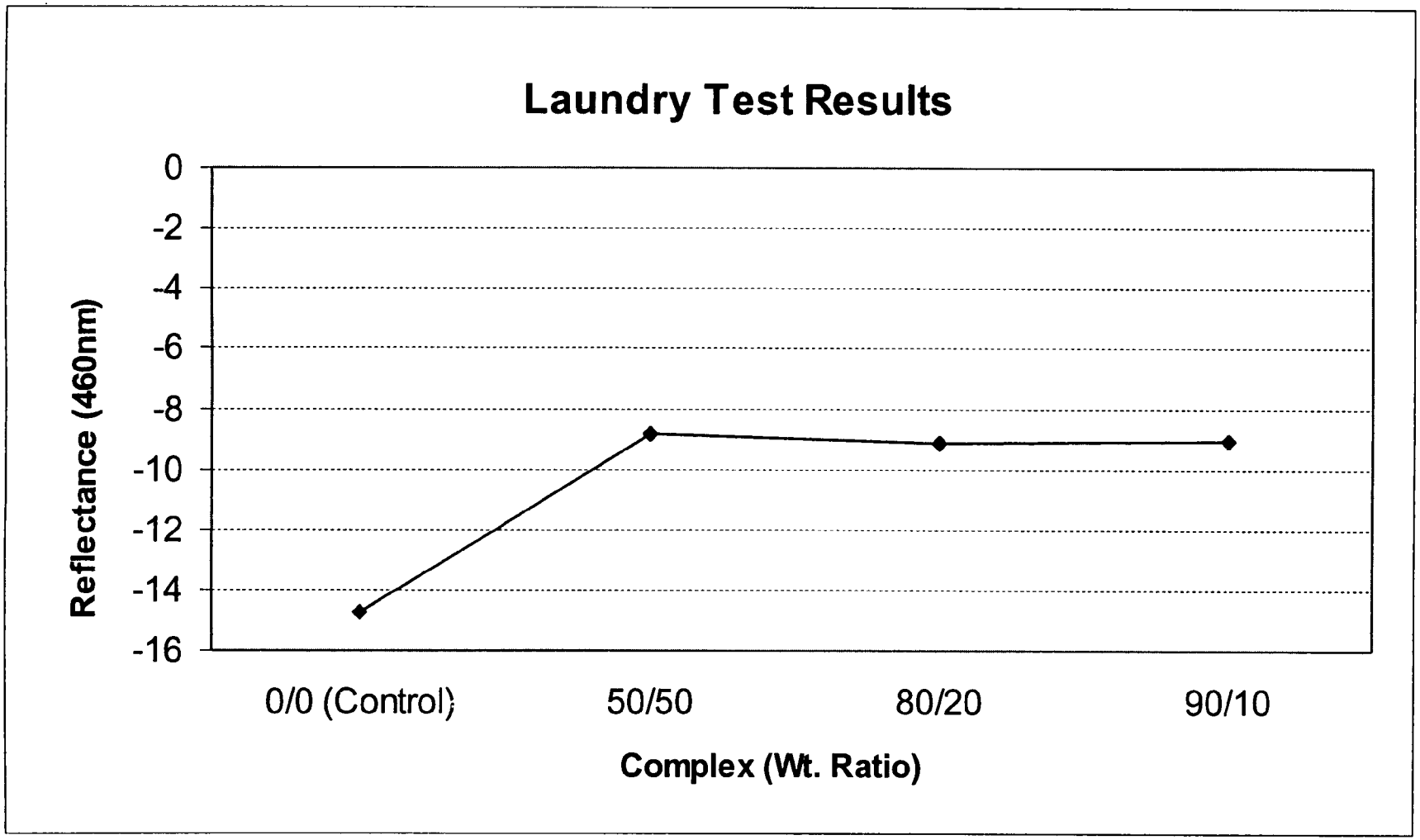
FIG. 2 illustrates laundry test results for the dirt suspending agent of the invention on cotton.

FIG. 2 shows the results of this test wherein the laundry formulation with the complex polymer of the invention had a reading closer to zero than the control indicating less dirt depositing onto the fabric.

While the invention has been described with particular reference to certain embodiments thereof, it will be understood that changes and modifications may be made which are within the skill of the art. Accordingly, it is intended to be bound only by the following claims, in which:

What is claimed is:

1. A dirt suspending agent for use in a laundry detergent formulation which comprises a blend of (a) isobutylene-maleic anhydride copolymer and (b) benzalkonium chloride wherein the molar ratio of component a to component b (a:b) is in a range from 50:50 to 80:20.

2. A laundry detergent formulation including the dirt suspending agent of claim 1.

* * * * *